US011098989B2

(12) United States Patent
Margareten

(10) Patent No.: US 11,098,989 B2
(45) Date of Patent: Aug. 24, 2021

(54) WEARABLE VEST WITH VESSEL AND OPTICAL SENSOR

(71) Applicant: Nesstoy/Bulk Unlimited Corporation, Brooklyn, NY (US)

(72) Inventor: Isamar Margareten, Brooklyn, NY (US)

(73) Assignee: Nesstoy/Bulk Unlimited Corporation, Brooklyn, NY (US)

( * ) Notice: Subject to any disclaimer, the term of this patent is extended or adjusted under 35 U.S.C. 154(b) by 0 days.

(21) Appl. No.: 17/214,015

(22) Filed: Mar. 26, 2021

(65) Prior Publication Data

US 2021/0215464 A1 Jul. 15, 2021

(51) Int. Cl.

| | |
|---|---|
| ***F41J 5/24*** | (2006.01) |
| ***A63F 9/02*** | (2006.01) |
| ***A63F 9/24*** | (2006.01) |
| ***F41A 33/02*** | (2006.01) |

(52) U.S. Cl.

CPC ..... *F41J 5/24* (2013.01); *A63F 9/0204* (2013.01); *A63F 9/24* (2013.01); *A63F 2009/247* (2013.01); *A63F 2009/2444* (2013.01); *A63F 2009/2452* (2013.01); *A63F 2009/2479* (2013.01); *A63F 2250/0428* (2013.01); *A63F 2250/05* (2013.01); *A63F 2250/166* (2013.01); *F41A 33/02* (2013.01)

(58) Field of Classification Search

CPC ... F41J 5/24; A63F 9/0204; A63F 9/24; A63F 2009/2479; A63F 2009/247; A63F 2250/05; A63F 2009/2444; A63F 2250/0428; A63F 2250/166; A63F 2009/2452; F41A 33/02

See application file for complete search history.

(56) References Cited

U.S. PATENT DOCUMENTS

| | | | | |
|---|---|---|---|---|
| 5,346,418 | A | 9/1994 | Aradj | |
| 5,904,621 | A | 5/1999 | Small et al. | |
| 5,984,788 | A * | 11/1999 | Lebensfeld | A63F 9/0291 463/51 |
| 6,302,796 | B1 | 10/2001 | Lebensfield et al. | |
| 8,469,824 | B1 | 6/2013 | Farley et al. | |
| 8,696,422 | B1 | 4/2014 | Santiago | |
| 10,390,603 | B2 * | 8/2019 | Hinson | A45F 5/021 |
| 2005/0279004 | A1 | 12/2005 | Woodmansee, III et al. | |

(Continued)

OTHER PUBLICATIONS

LUKAT Laser Tag Gun (NPL—Video uploaded to YouTube on Dec. 6, 2020 by KaraC1013 titled "LUKAT Laser Tag Guns Review, Fun way to kill time"—https://www.youtube.com/watch?v=bjvnvElgkG0) (Year: 2020).*

(Continued)

*Primary Examiner* — Michael D Dennis

(74) *Attorney, Agent, or Firm* — Thorpe North & Western

(57) ABSTRACT

A wearable vest having an optical sensor is disclosed with a vessel configured to hold a selected liquid. A nozzle is connected to the vessel. The optical sensor is configured to receive an encoded optical signal from one or more of a plurality of optical signal sources. One or more processors coupled to the optical sensor are configured to determine information in the encoded signal, select a response based on the information, and send a signal to enable the selected liquid to be directed out of the vessel through the nozzle towards a wearer of the wearable vest for a selected period of time based on the selected response.

27 Claims, 11 Drawing Sheets

(56) References Cited

U.S. PATENT DOCUMENTS

| | | | | |
|---|---|---|---|---|
| 2006/0287113 | A1* | 12/2006 | Small | F41A 33/02 463/51 |
| 2007/0056998 | A1* | 3/2007 | Olson | A45F 3/20 224/148.2 |
| 2008/0188314 | A1 | 8/2008 | Rosenblum | |
| 2010/0016085 | A1 | 1/2010 | Inoue | |
| 2011/0059675 | A1* | 3/2011 | Liebling | A63H 23/10 446/153 |
| 2017/0079329 | A1 | 3/2017 | Zitzke | |
| 2018/0353845 | A1 | 12/2018 | Fischer et al. | |
| 2019/0321718 | A1* | 10/2019 | Margareten | A63F 9/0291 |

OTHER PUBLICATIONS

NESSTOY®: "Balloon Battle;" armogear.com; (2021): 2 pages; (retrieved on Jun. 21, 2021); Retrieved from [URL: https://armogear.com/products/balloon-battle ].

NESSTOY®; "Battle Bug—Laser Battle Add-On;" armogear.com; (2021); 2 pages; Retrieved from [URL: https://armogear.com/products/battle-bug-laser-battle-add-on ].

NESSTOY®; "Beat the Bug—Mini Blaster + Spider Set;" armogear.com; (2021); 2 pages; (retrieved on Jun. 21, 2021); Retrieved from [URL: https://armogear.com/products/beat-the-bug-mini-blaster-spider-set ].

NESSTOY®; "Boxing Battle—2 Electronic Vests & 2 Pairs of Gloves;" armogear.com; (2021); 3 pages; (retrieved on Jun. 21, 2021); Retrieved from [URL: https://armogear.com/products/boxing-battle-2-electronic-vests-2-pairs-of-gloves ].

NESSTOY®; "Laser Battle Guns & Vests—Four Pack;" armogear.com; (2021); 1 page; (retrieved on Jun. 21, 2021); Retrieved from [URL: https://armogear.com/collections/laser-battle-gun-and-vest/products/4-pack-guns-vests ].

NESSTOY®; "Laser Gun Tag Game 4 Pack;" kidzlane.com; (2020); 3 pages; (retrieved on Jun. 21, 2021); Retrieved from [URL: https://kidzlane.com/products/laser-tag-game-mega-pack-set-of-4 ].

NESSTOY®; "Laser Tag 2 Pack with Vests & Spider;" kidzlane.com; (2020); 4 pages; (retrieved on Jun. 21, 2021); Retrieved from [URL: https://kidzlane.com/collections/new-releases-test/products/laser-tag-2-pack-with-vests-spider ].

NESSTOY®; "Laser Tag;" armokidz.com; (2017); 2 pages: (retrieved on Jun. 21, 2021); Retrieved from [URL: http://armokidz.com/ ].

NESSTOY®; "Mini Battle Blasters—4 Pack;" armogear.com; (2021); 2 pages; (retrieved on Jun. 21, 2021); Retrieved from [URL: https://armogear.com/collections/accessories/products/mini-battle-blasters-4-pack ].

NESSTOY®; "Rechargeable Laser Battle Guns & Vests—4 Pack;" armogear.com; (2021); 2 pages; (retrieved on Jun. 21, 2021); Retrieved from [URL: https://armogear.com/products/beat-the-bug-mini-blaster-spider-set ].

* cited by examiner

WEARABLE VEST WITH VESSEL AND OPTICAL SENSOR

BACKGROUND OF THE INVENTION

1. Field of the Invention

This invention relates to a wearable vest comprising a vessel and an optical sensor; and more particularly relates to a wearable vest that is configured to emit liquid towards a wearer when an optical sensor is successfully targeted in a gaming environment, and providing feedback to the user and others regarding the targeting.

2. Description of the Related Art

Laser tag is a popular game and competitive sport that is typically played indoors in relatively dark, enclosed areas large enough to allow game players to run around and hide from opponents during a game. Individuals or groups are often divided into teams that compete against each other to target optical sensors with the laser guns. A large number of game variations are available, but the ultimate goal is typically for an individual or team to successfully target the optical sensors of their opponents the greatest number of times.

The use of large, enclosed areas to play laser tag can increase the cost of playing the game as well as the cost of hosting the games. In addition, laser tag can be seasonal, with large indoor laser tag centers being used infrequently during warm summer months. This can increase the cost of hosting and playing laser tag.

BRIEF DESCRIPTIONS OF THE DRAWINGS

With the above and other related objectives in view, the invention consists in the details of construction and combination of parts, as will be more fully understood from the following description, when read in conjunction with the accompanying drawings in which.

DETAILED DESCRIPTION OF THE EMBODIMENTS OF THE INVENTION

Figure 1:
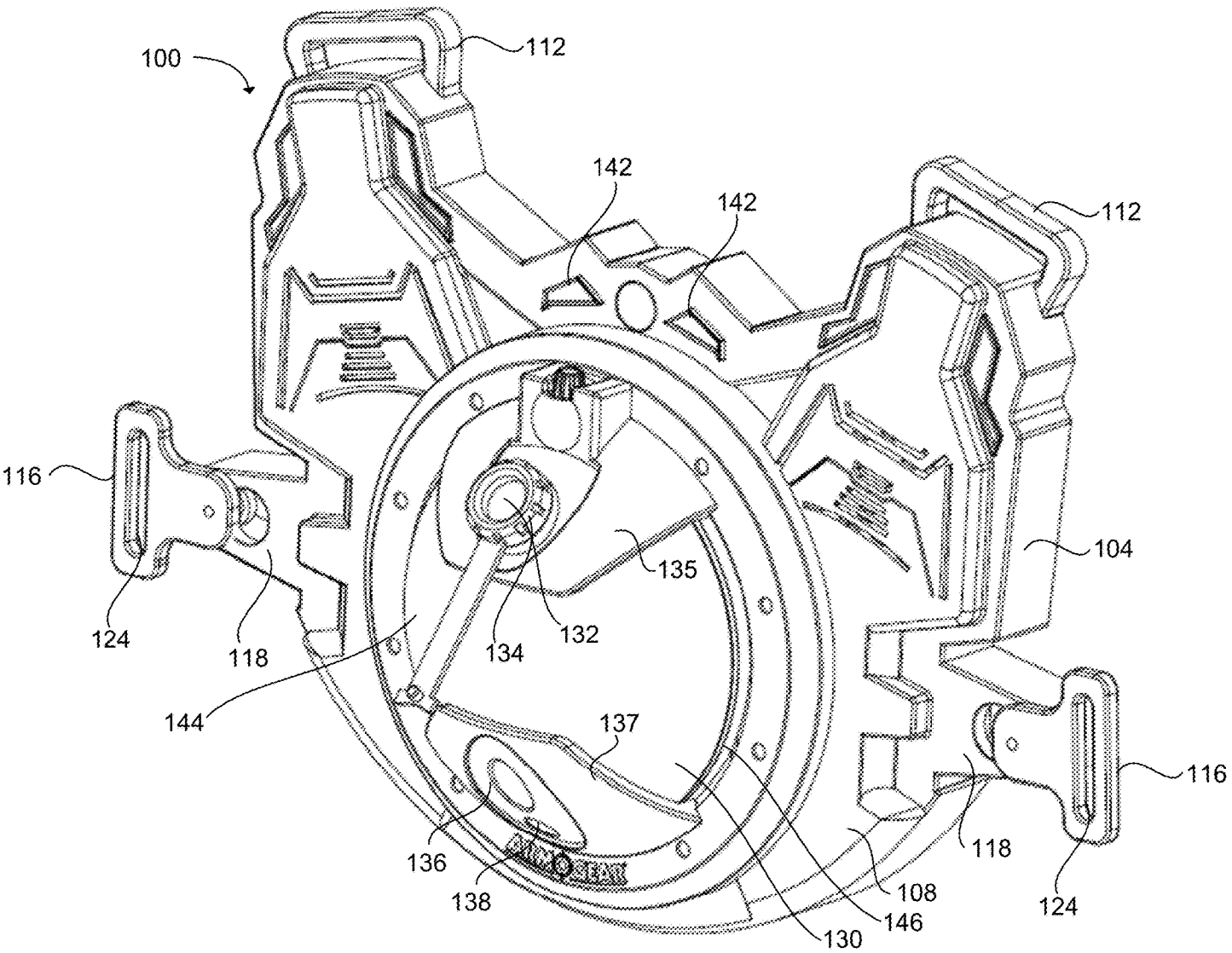
FIG. 1 is a first schematic perspective view of a wearable vest with a vessel and an optical sensor in accordance with an embodiment of the present invention.

Illustrative embodiments of the present invention are described below. The following explanation provides specific details for a thorough understanding of and enabling description for these embodiments. One skilled in the art will understand that the invention may be practiced without such details. In some instances, well-known structures, processes, and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

A wearable vest is disclosed that carries a vessel and an optical sensor. The vessel is configured to hold water or another desired liquid. A nozzle is connected to the vessel. The nozzle can direct the desired liquid from the vessel towards a user (i.e. wearer) of the vest. In one example, multiple players can each be outfitted with the wearable vests for a game of laser tag. The game can be played outside. Individuals or groups of players can be divided into two or more teams. Each vest can be associated with a selected team. Laser guns can also be associated with a selected team. When the optical sensor of the wearable vest is successfully targeted by a laser gun of a player on another team, the liquid in the vessel can be directed for a period of time through the nozzle at the wearer of the successfully targeted wearable vest. The liquid directed from the nozzle on the wearable vest at the player provides feedback to the player letting the player know that their vest has been successfully targeted by an opposing player. Additional feedback can be provided by sounds and lights emitted by the successfully targeted vest, informing other players that the wearable vest was successfully targeted. Game rules can be implemented to determine how many times a player is to be successfully targeted (i.e. hit by an opposing player's laser gun) before the player is ejected from the game. The last individual or team member in the game can be declared the winner.

The use of the wearable vest that carries the vessel and the optical sensor in the example laser tag game enables the laser tag game to be expanded for use in an outdoor environment. The desired liquid directed through the nozzle from the vessel upon a successful targeting of the wearable vest by an opponent provides a simple, sudden, tactile feedback that enables a player to instantly know when they have been successfully targeted. Unlike traditional sounds, lights, and buzzers used as feedback in a game of laser tag, the use of the liquid allows the laser tag game to be played in a bright, open, noisy environment while still enabling the player to understand when they have been successfully targeted by an opponent on another team. The player can then respond to the physical consequences of being sprayed by a liquid from the vessel by altering their play to reduce the chances of being successfully targeted again. The physical consequences can make the game seem more realistic and encourage individuals and teams to play. The activity provided by gameplay outside can encourage healthy physical exercise in lieu of the typical use of sedate, indoor electronics such as video games. In addition, the wearable vest can provide cooling to the players in the outside environment. The cooling effect can be significant for active players on a hot summer day.

The use of the wearable vest in an outside environment can significantly reduce the cost of playing laser tag relative to the cost of playing in an indoor, enclosed environment. For example, kids in a family or neighborhood can each use a wearable vest with a vessel and optical sensor to play laser tag games at locations throughout their neighborhood without the need to pay for each game, as is typical for indoor laser tag games. The wearable vest can combine the water fight industry with the infrared tag industry.

Referring to FIGS. 1-10, a wearable vest 100 is shown in accordance with an example of the invention. The wearable vest 100 includes a breastplate 104 with a back surface 106 (FIG. 4) configured to face a player's torso and an opposite front surface 108 and wall configured to face away from the torso. In one aspect, the breastplate 104 can be substantially rigid and formed from a rigid material, such as a plastic or a composite material. Alternatively, the breastplate 104 can be formed from a flexible material, such as a foam material. A foam material may also be attached to the back surface 106 to provide added comfort to the user. A closed cell foam can be used that will resist absorption of liquids such as water during gameplay. In one aspect, the vest 100 and the breastplate 104 can be configured as a gorget.

Figure 9:
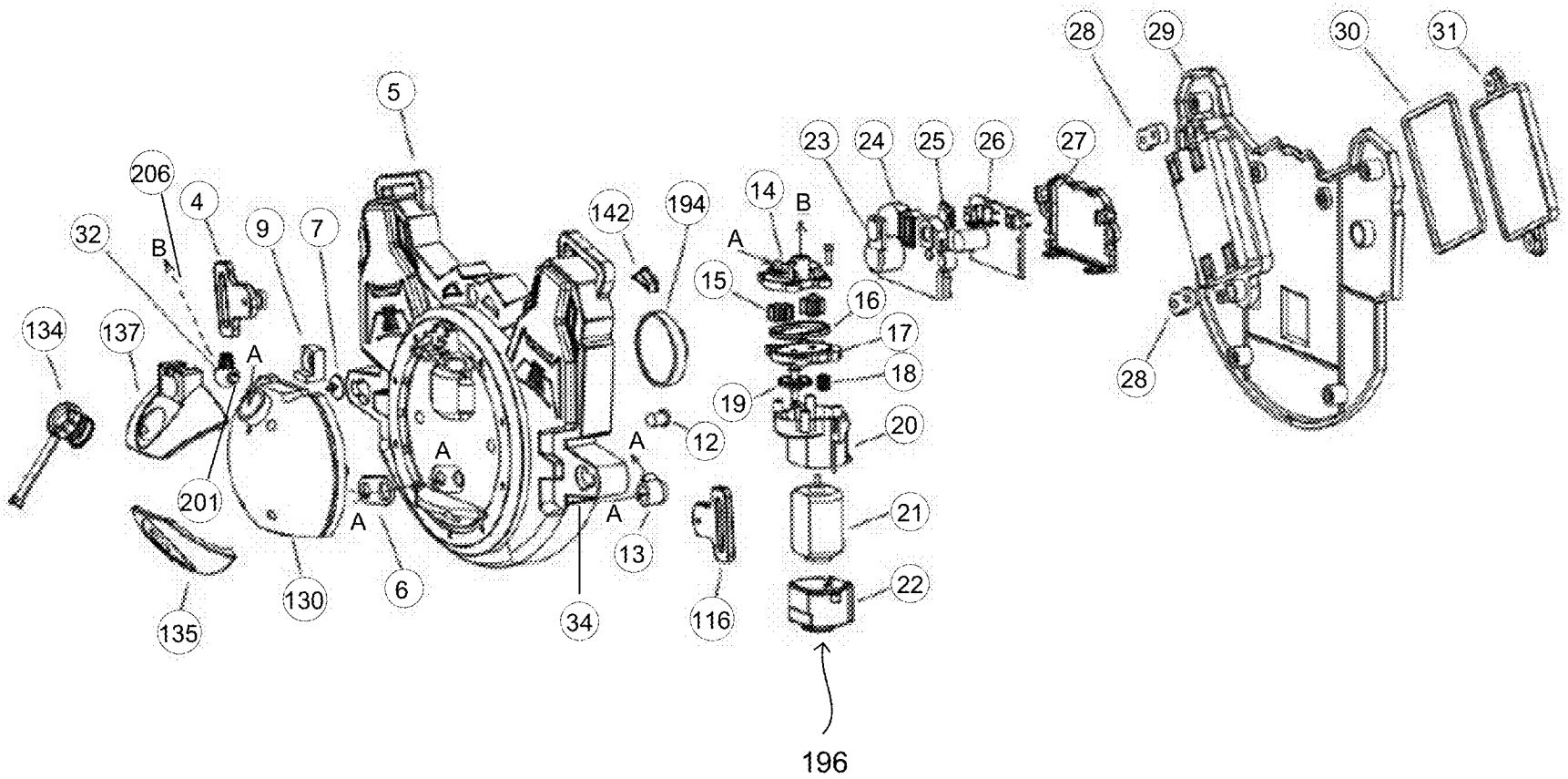
FIG. 9 is an exploded schematic perspective view of the wearable vest of FIG. 1 in accordance with an embodiment of the present invention.
Figure 11:
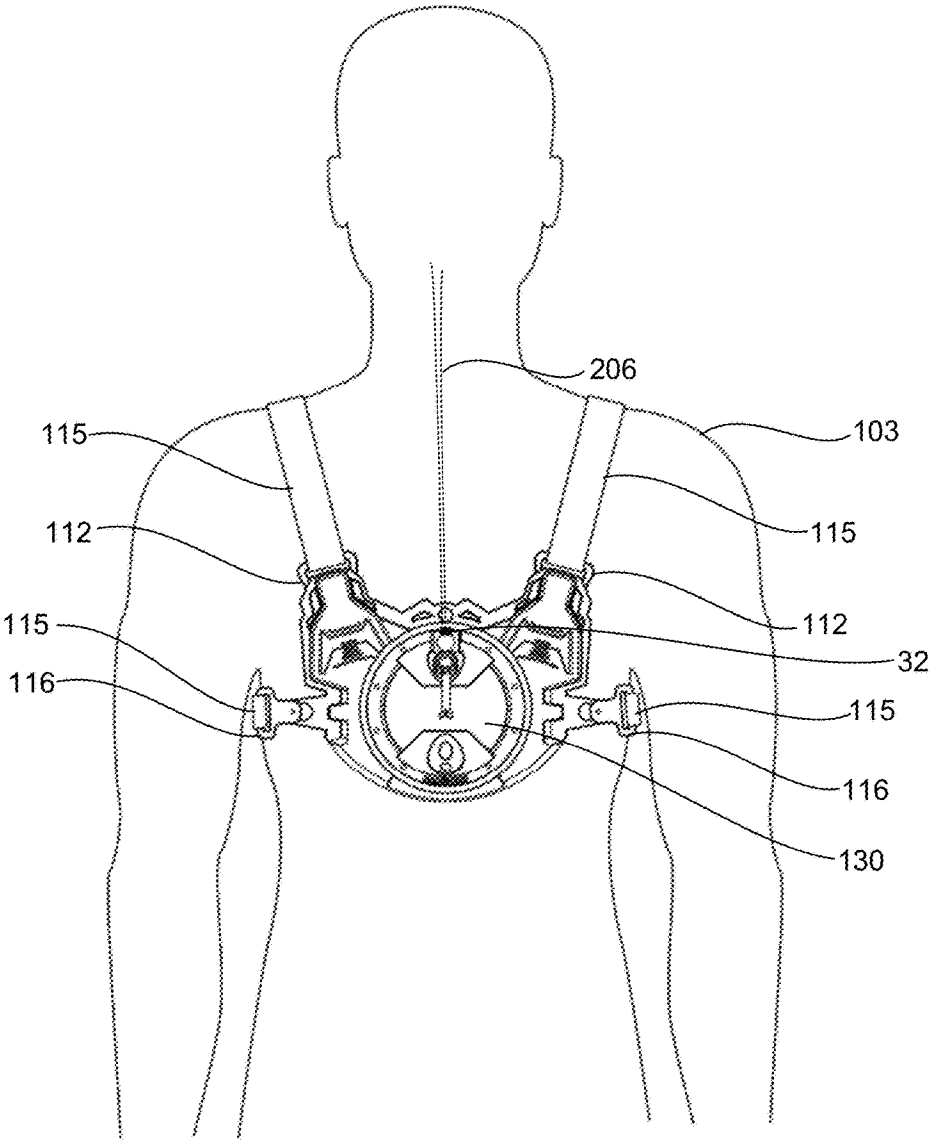
FIG. 11 is an illustration of a user wearing the wearable vest illustrated in the examples of FIGS. 1-8 in accordance with an embodiment of the present invention.

As illustrated in FIG. 1, the breastplate 104 can include top attachments 112 and side attachments 116. Each of the attachments can include through holes 124 sized to receive straps. As illustrated in FIG. 11, the straps 115 can be inserted through and attached to each of the attachment locations. The straps 115 can be used to attach the wearable vest 100 to a wearer 103. The terms player, user, and wearer are used interchangeably throughout the specification. The straps 115 may include a buckle to open the strap 115 for attachment to the player. In another example, one or more of the side attachments 116 can be removably attachable to the breastplate 104 via the keyholes 34 (FIG. 9).

Figure 4:
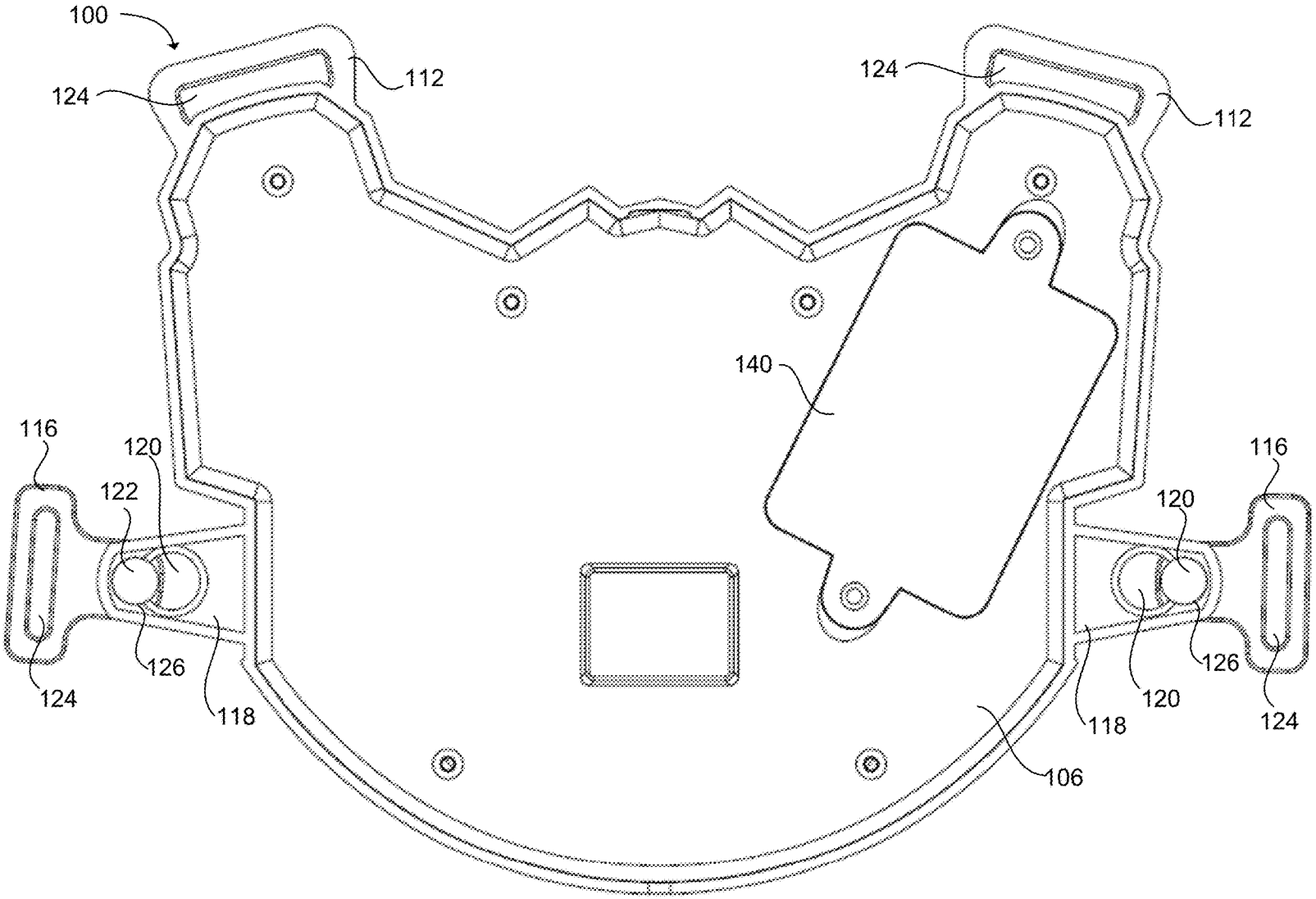
FIG. 4 is a rear view of the wearable vest of FIG. 1.
Figure 5:
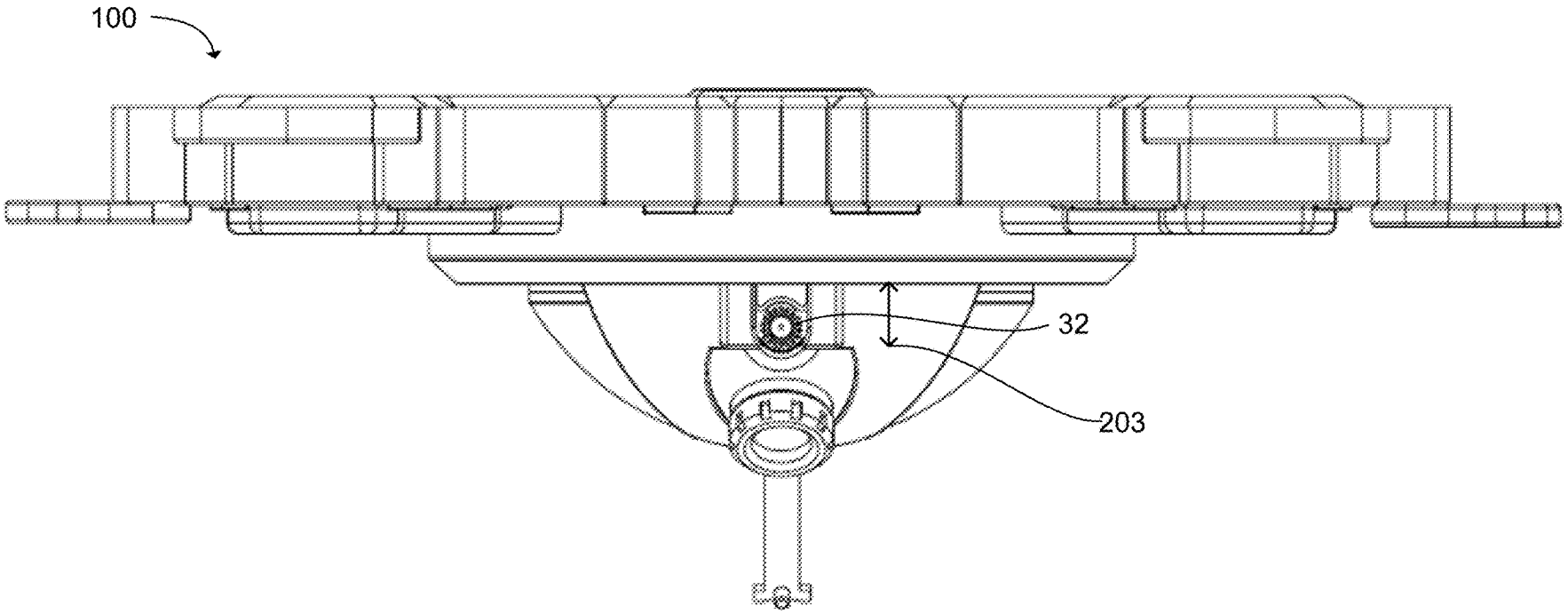
FIG. 5 is a top view of the wearable vest of FIG. 1.
Figure 6:
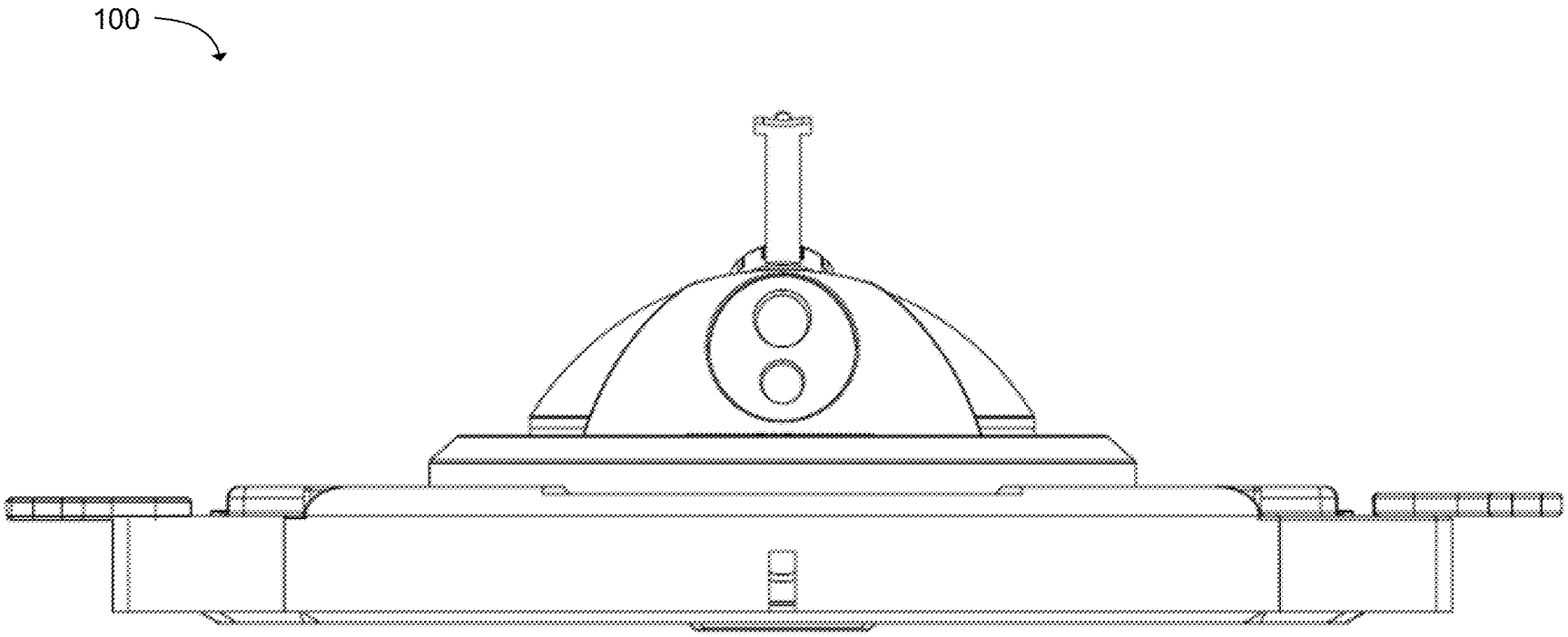
FIG. 6 is a bottom view of the wearable vest of FIG. 1.

In one example, the breastplate 104 can include a side attachment accepter 118, illustrated in FIG. 4, that includes keyholes 34 (FIG. 9) comprising a first through hole 120 and a second through hole 122 adjacent to and overlapping the first through hole 120. The side attachment 116 can include a strap opening 124 for a strap 115 to be inserted through the strap opening 124. The side attachment can also include a circular member 126 offset from, and attached to the side attachment 116 by a selected distance. The circular member 126 can be attached to the side attachment 116 by a post. A diameter of the first through hole 120 can be greater than a diameter of the circular member 126. A diameter of the second through hole 122 can be less than the diameter of the first through hole 120 and also less than a diameter of the circular member 126. The circular member 126 can be inserted into the first through hole 120. The post can be moved into the second through hole 122 which can be configured to bind the post and circular member 126 of the side attachment 116 to the side attachment accepter 118. The side attachment 116 can be removed from the side attachment acceptor 118 by moving the post from the second through hole 122 to the first through hole 120 and moving the circular member 126 through the first through hole 120, as illustrated in back view of the wearable vest 100 illustrated in the example of FIG. 4. The wearable vest 100 can be removed from a player once the side attachment 116 is removed from the side attachment acceptor 118, thereby opening the straps 115.

The wearable vest 100 can carry a vessel 130 that is configured to hold the selected liquid, such as water. The vessel 130 can be comprised of a waterproof material, such as a plastic, a composite, or a metal. In one embodiment, the vessel 130 can be formed as a bulbous protrusion extending from the front surface 108 of the breastplate 104, as shown in FIGS. 1, 2 and 4-7. The vessel 130 can have a lateral dimension occupying a majority of a lateral dimension of the breastplate 104. The vessel 130 can include a sealable aperture 132 that is formed at least partially in the bulbous protrusion. The sealable aperture 132 can comprise a nipple extending through the front wall of the breastplate 104 for ease of access. The sealable aperture 132 is configured to receive the selected liquid into the vessel. For example, water can be poured or directed into the vessel through the sealable aperture. A liquid input cover 134 can be removably attached to the sealable aperture 132. The liquid input cover 134 can be removably coupled to the sealable aperture and nipple thereof to seal the selected liquid in the vessel 130. A drain aperture 136 in the vessel 130 with a drain cover 138 can be used to drain the selected liquid from the vessel 130 by removing the drain cover 138 and allowing the liquid to flow out of the vessel 130. The drain aperture 136 can be positioned to allow the selected liquid to flow out of the vessel 130 through the drain aperture 136 with the help of gravity. The vessel can be substantially rigid. In one embodiment, a flexible bladder can be contained within the rigid vessel. Alternatively, the vessel can be comprised of a flexible bladder, such as a rubber bladder.

In one aspect, the vest 100 and the breastplate 104 can have a protrusion 144 extending from a front surface 108 of the breastplate 104. The protrusion 144 can have a lateral dimension occupying a majority of a lateral dimension of the breastplate 104. In addition, the protrusion 144 can be bulbous and shaped as a hemisphere. In another aspect, the vest 100 and the breastplate 104 can have an aperture 146 in the front surface 108 of the breastplate 104. In one aspect, the aperture 146 can be at least partially formed in and located in the protrusion 144. In another aspect, the protrusion 144 and the front surface 108 of the breastplate 104 can have upper and lower lobes 135 and 137 extending from the front surface 108. The aperture 146 can be formed in the bulbous protrusion 144 between the lobes 135 and 137.

In another aspect, the vessel 130 can be at least partially located in the bulbous protrusion 144. The vessel 130 can have a hemispherical dome extending from the front surface 108 of the breastplate 104 and filling the protrusion 144. The upper lobe 135 can extend from the front surface 108 of the breastplate 104 and over an upper portion of the hemispherical dome of the vessel 130. Similarly, the lower lobe 137 can extend from the front surface 108 of the breastplate 104 and over a lower portion of the hemispherical dome of the vessel 130. Thus, the lobes 135 and 137 can help retain the vessel 130 in the breastplate 104, while providing for the aperture 146. The protrusion 144 can provide a greater volume in the breastplate 104, and can allow for the vessel 130 to have a greater volume in order to contain more water. In another aspect, the vessel 130 can close the aperture 146 in order to close the vest 100. In another aspect, at least a portion of the vessel 130, such as the hemispherical dome, can be exposed through and visible through the aperture 146 and between the lobes 135 and 137. In one aspect, at least a portion of the vessel 130 can be at least light translucent. Thus, a water volume of the vessel 130 can be ascertained visibly through the aperture 146 in the front surface 108 and bulbous protrusion 144.

The portion of the vessel 130 visible through the aperture 146 can further define an illumination portion. A light source 192 can be carried by the breastplate 104 and electrically coupled to a power source or battery 184. In addition, the light source 192 can be positioned to illuminate the illumination portion of the vessel 130. Thus, a greater surface area of the vest 100 and the breastplate 104, such as the illumination portion of the vessel 130 in the aperture 146, can be illuminated.

Figure 10:
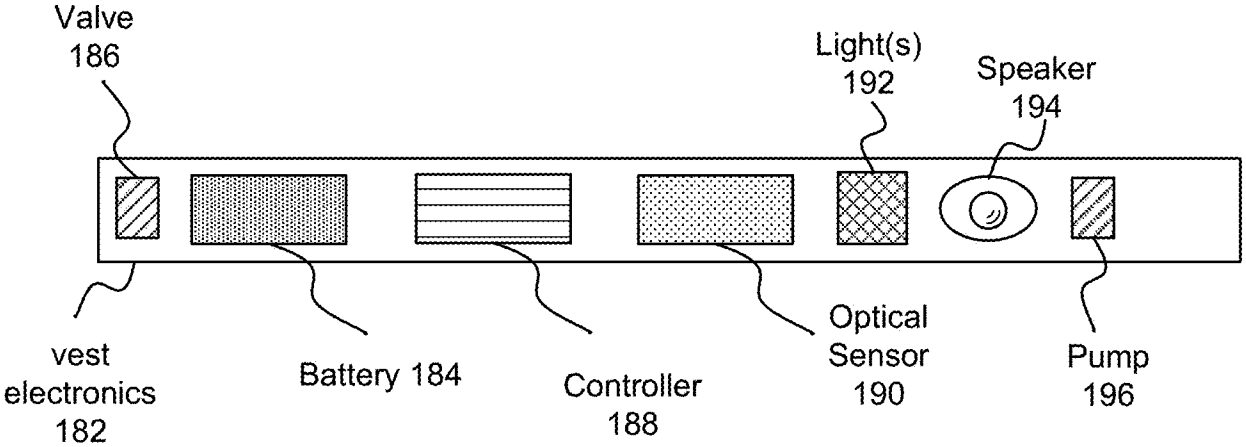
FIG. 10 is an illustration of electronic elements of the wearable vest coupled to a power supply and one or more processors in accordance with an embodiment of the present invention.

The breastplate 104 can be configured to contain a power supply, such as a plurality of batteries 184 (FIG. 10). For example, a battery compartment 140 can be carried in the back surface 106 of the breastplate 104. A battery compartment cover 31 can be securely fastened to the back surface using screws or another desired type of attachment mechanism, as shown in the exploded view of FIG. 9. A ring seal 30 can be used to substantially seal the battery compartment from the selected liquid contained within and emitted from the vessel 130. The batteries 184 in the battery compartment 140 can be coupled in series or parallel to form a power supply with a desired voltage and current. The battery compartment 140 can be configured to hold a standardized battery size, such as size AA or AAA. The power supply can be used to power the vest electronics 182, as shown in FIG. 10.

The vest electronics 182 illustrated in FIG. 10 can be carried within the breastplate 104 of the wearable vest 100 between the front body 5 and the rear body 29 (FIG. 9). The vest electronics 182 can be located in a single area, such as on a printed circuit board (PCB) 26 mounted within the breastplate 104 between the front body 5 and the back body 29. Alternatively, the vest electronics 182 may be distributed throughout the breastplate 104. The vest electronics can include a controller 188, an optical sensor 190, one or more light sources 192, an audio speaker 194, and a pump 196. A valve 186 may be included instead of the pump 196, or in combination with the pump 196. Each of the vest electronics can be powered by the batteries 184. The vest electronics will be described more fully in the proceeding paragraphs.

The breastplate 104 can be configured to securely hold the vessel 130 between the front surface 108 and the back surface 106. In one example, at least a portion of the vessel 130 can be displayed. The upper lobe 135 and the lower lobe 137 can be used to secure the vessel 130 to a front body 5 (FIG. 9) of the breastplate 104. The vessel 130 can be opaque, translucent, or transparent. In one embodiment, the light source 192 can be mounted adjacent to the vessel.

The wearable vest 100 can include an On/team selector switch 142. A single switch or multiple switches may be used. In one example, a single On/team selector switch 142 can be a button mounted on and carried by the front surface 108 of the breastplate 104. The button can be referred to as a team selection button. A single On/team selector switch (team selection button) 142 can be configured to turn the wearable vest 100 to an "On" state when the switch 142 is depressed a first time. Each additional depression of the switch 142 can change the wearable vest 100 to a different team. In one embodiment, the team for the wearable vest can be selected by depressing the single On/team selector switch 142 a first to an nth time to select a first to an nth team, respectively, for the wearable vest.

The controller 188 can be comprised of one or more digital processors and memory. The memory can be coupled to the one or more digital processors. The one or more digital processors can be general purpose processors, specialized processors such as very large scale integrated (VLSI) circuits, field programmable gate array processors (FPGAs), or other types of specialized processors, as well as baseband processors used in transceivers to send, receive, and process wireless communications. In one example, the controller 188 can be configured to change a color of the light source 192 for each team selected by depressing the On/team selector switch 142. In one embodiment, the light source 192 can be a single or multiple LED(s) 12 (FIG. 9) mounted adjacent to the vessel 130. A team can be represented as a selected color, such as a green team, an orange team, a blue team, or a red team. As the light source 192 color is changed each time the On/team selector switch 142 is depressed, the controller can change the color of the LED(s) 9 to provide a selected color for the translucent vessel 130. The color of the translucent vessel can be used to show the selected team of the wearer 103 of the wearable vest 100. The bulbous protrusion of the vessel 130 enables the wearer 103 to see the color of the translucent vessel, and accordingly the selected team, even while wearing the wearable vest 100.

In another example, the controller 188 can be configured to send audio signals to the speaker 188. The speaker can generate audio to inform the wearer 103 which team is selected. For instance, each time the On/team selector switch 142 is depressed the speaker can be configured to say the selected color, such as "green", "orange", "blue", or "red" to refer to the team selected for the wearable vest 100. The audio from the speaker 188 and the color from the light source 192 can both be used to identify the team selected for the wearable vest. The colors used in this example are not intended to be limiting. The controller 188 and light source 192 can be configured to provide any desired color for a selected team. The controller 188, comprised of one or more processors and memory, can also be configured to send a predetermined audio message based on information received in an encoded optical signal at the optical sensor 190. For example, the audio message may pertain to which team successfully targeted the optical sensor 190, such as "Hit! Red Team". The encoded optical signal can also include information related to the type of optical signal source used to target the optical sensor 190. The controller 188 can send a predetermined audio message based on the type of optical signal source that successfully targeted the optical sensor 190, such as "Hit! Grenade" or "Hit! Land mine", or another predetermined audio message. The controller 188 can also send a predetermined audio message reminding the wearer 103 of the wearable vest 100 how many hits they have left based on the hits received in a selected game, such as "Two hits remaining". The audio can be provided in multiple languages.

In one example, the wearable vest 100 can include a pump 196, such as a water pump. One embodiment of the pump 196 is illustrated in FIG. 9. In this embodiment, the pump comprises a motor 21 with a front motor cover 20 and a rear motor cover 22. The pump is coupled to the motor, the pump comprising a front portion of the pump 14 and gears 15 within the pump. The gears 15 in the pump are coupled to the motor gear 18 of the motor 20 via the gear 19. The gear ratio of the diameter of the gear 19 relative to the diameter of the motor gear 18 is selected to drive the selected liquid through the pump and out the tube 13 and out of the nozzle 32 at a selected speed. A waterproof ring 16 and a rear portion of the water pump 17 are used to seal the selected liquid within the pump.

The two gears 15 are configured to spin in opposite directions within the volume created between the pump front end 14 and the rear portion of the pump 17. For example, one of the gears 15 can turn in a clockwise manner and the other gear can turn in a counterclockwise manner. The movement of the gears causes the water in each of the gear compartments between the pump front end 14 and the rear portion of the pump 17 to spin in opposite directions. As the gears 15 in the pump are turning at a predetermined speed, a centrifugal force will push the selected liquid in the direction in which the gears are turning. At the same time, the liquid will be sucked into the pump housing from the opposite side. In the example of FIG. 9, liquid, such as water, can be directed by the pump from an orifice in the vessel 130, following the arrows labeled "A", through a hole in a waterproof sheet 6, to a tube 13 and into the pump front 14, through the pump 196, out of the orifice labeled "B" in the pump front 14, and directed out of a nozzle 32. The speed at which the gears 15 are rotated and the size of the gears 15 are both directly related to the height (speed) at which the liquid 206 is directed out of the nozzle 32. Increasing the speed of the gears can increase the height of the liquid 206 directed from the nozzle 32 towards the wearer 103, as shown in FIG. 11.

Figure 7:
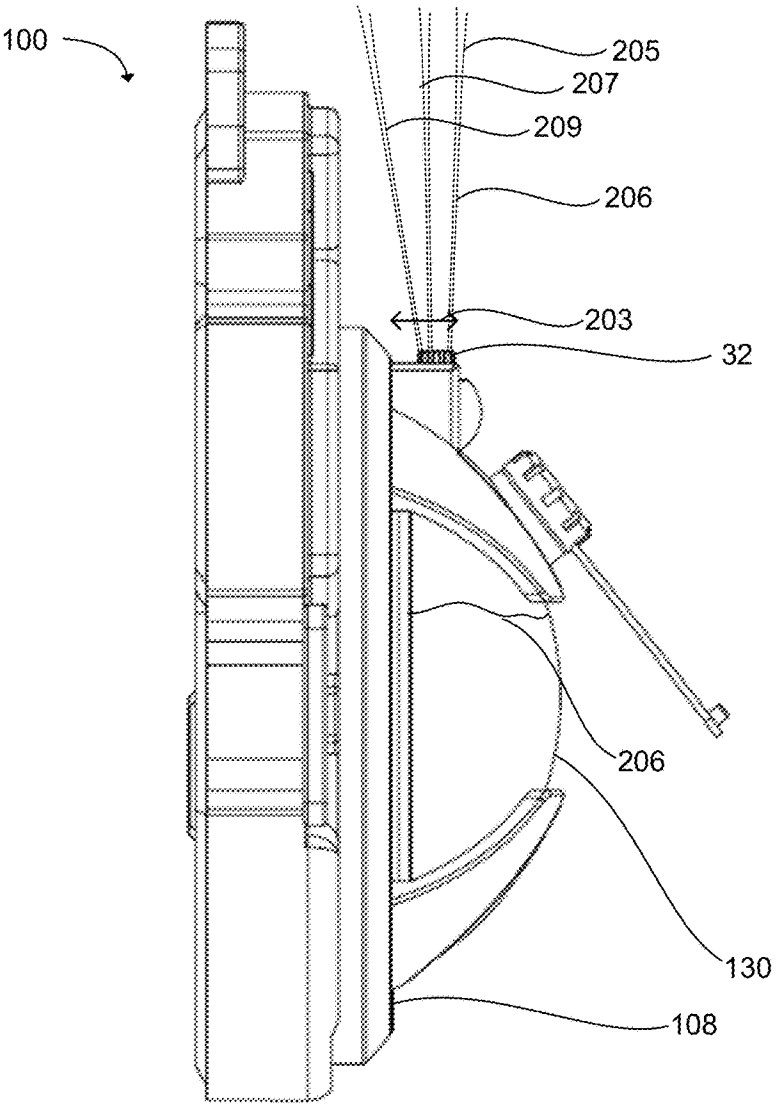
FIG. 7 is a right-side view of the wearable vest of FIG. 1.
Figure 8:
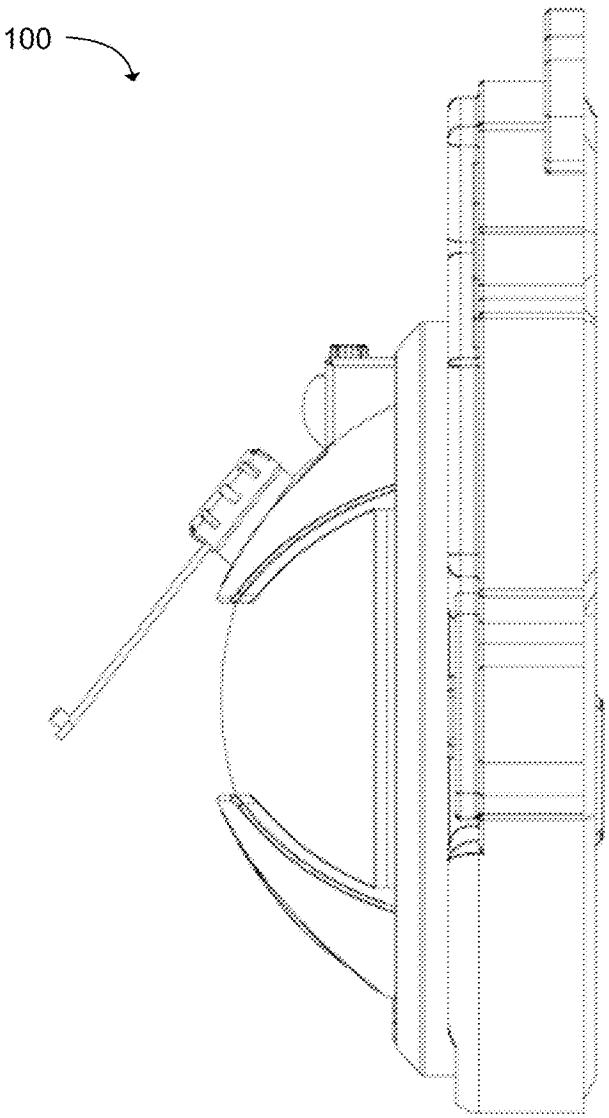
FIG. 8 is a left-side view of the wearable vest of FIG. 1.

In the example of FIG. 9, the nozzle 32 can be coupled to a ball joint 35 (FIG. 3) that allows the nozzle 32 to be moved in two or more directions. For example, in the top view of the example illustrated in FIG. 5, the nozzle 32 in the wearable vest 100 can be directed in a forwards or backwards direction relative to the front surface 108 to control a direction of the selected liquid directed out of the vessel 130, as shown by the arrows 203. The liquid 206, such as water, is illustrated in FIG. 7 in the vessel 130, with the fill line of the liquid 206 in the vessel 130 shown by the wavy line. The liquid 206 is also shown being directed from the vessel 130 out of the air opening of the nozzle 32, and through the air, in three examples, as illustrated by the dashed lines 205, 207 and 209 showing the liquid directed out of the air opening of the nozzle 32. In a first example, the nozzle 32 is shown directed in the forwards direction 205 to direct the water slightly away from the front surface 108 of the wearable vest 100. In a second example, the nozzle 32 is shown in a center direction 207 to direct the liquid 206 substantially upwards out of the nozzle 32 substantially parallel to the front surface 108 of the wearable vest 100. In a third example, the nozzle 32 is shown in a slightly backwards direction 209 to direct the liquid 206 slightly towards the front surface 108 of the wearable vest 100. In each example, the nozzle 32 is configured to direct the liquid 206 towards a portion of the face or body (typically upper body) of the user that is wearing the wearable vest 206. FIG. 11 shows the liquid 206 that is directed from the vessel 130 out of the air opening of the nozzle 32, and through the air towards the wearer 103 (i.e. user or player).

The position of the nozzle 32 can be selected by the wearer 103 of the wearable vest 100 to ensure comfort and safety when the liquid is streamed out of the nozzle 32 towards the wearer 103. The volume and velocity of the liquid 206 being directed out of the nozzle 32 can be selected to allow the wearer 103 of the wearable vest 100 to instantly recognize when the liquid 206 comes in contact with the wearer 103 or with clothing worn by the wearer 103. The velocity can be selected to enable the liquid 206 to come in contact with the wearer's chin, neck, face, and/or or chest, as shown in FIG. 11. However, the velocity is selected to be below a velocity that could be dangerous to the wearer 103. The liquid 206 can be ejected from the nozzle in a sufficiently dispersed (i.e. non-focused) manner so as to minimize any chance of danger when the liquid contact's the wearer's eyes or nose.

In one aspect, the nozzle 32 can be positioned on the bulbous protrusion 144 and on the upper lobe 135. Thus, the protrusion 144 and the upper lobe 135 can extend from the breastplate 104 to position the nozzle 32. Similarly, the sealable aperture 132 can be positioned on the bulbous protrusion 144 and on the upper lobe 135. For example, the sealable aperture 132 can comprise a nipple extending through the front wall of the breastplate 104 on the upper lobe 135.

In the example of FIG. 9, a printed circuit board (PCB) 26 can include an optical sensor 190 (FIG. 10) with a sensor cover 23, a front PCB cover 24, a water proof sheet 25, and a rear PCB cover 27. The controller 188 (FIG. 10) can be electrically coupled to the PCB 26 and the optical sensor 190. Nut covers 28 can be used to attach the rear body 29 of the breast plate 104 to the front body 5. A battery lid (compartment cover) 31 and a sealant ring 30 can be used to seal the batteries 184 in the battery compartment 140 (FIG. 10).

Continuing with the exploded view of FIG. 9, the liquid input cover 134 is configured to attach to the vessel 130. The vessel 130 is attached to the front body 5 using the lower lobe 135 and upper lobe 137. An air valve 7 is configured to attach to the vessel 130 and allow air to flow into the vessel as water is pumped out through the nozzle 32. A waterproof plug 9 can be coupled to a back of the vessel 130.

Figure 2:
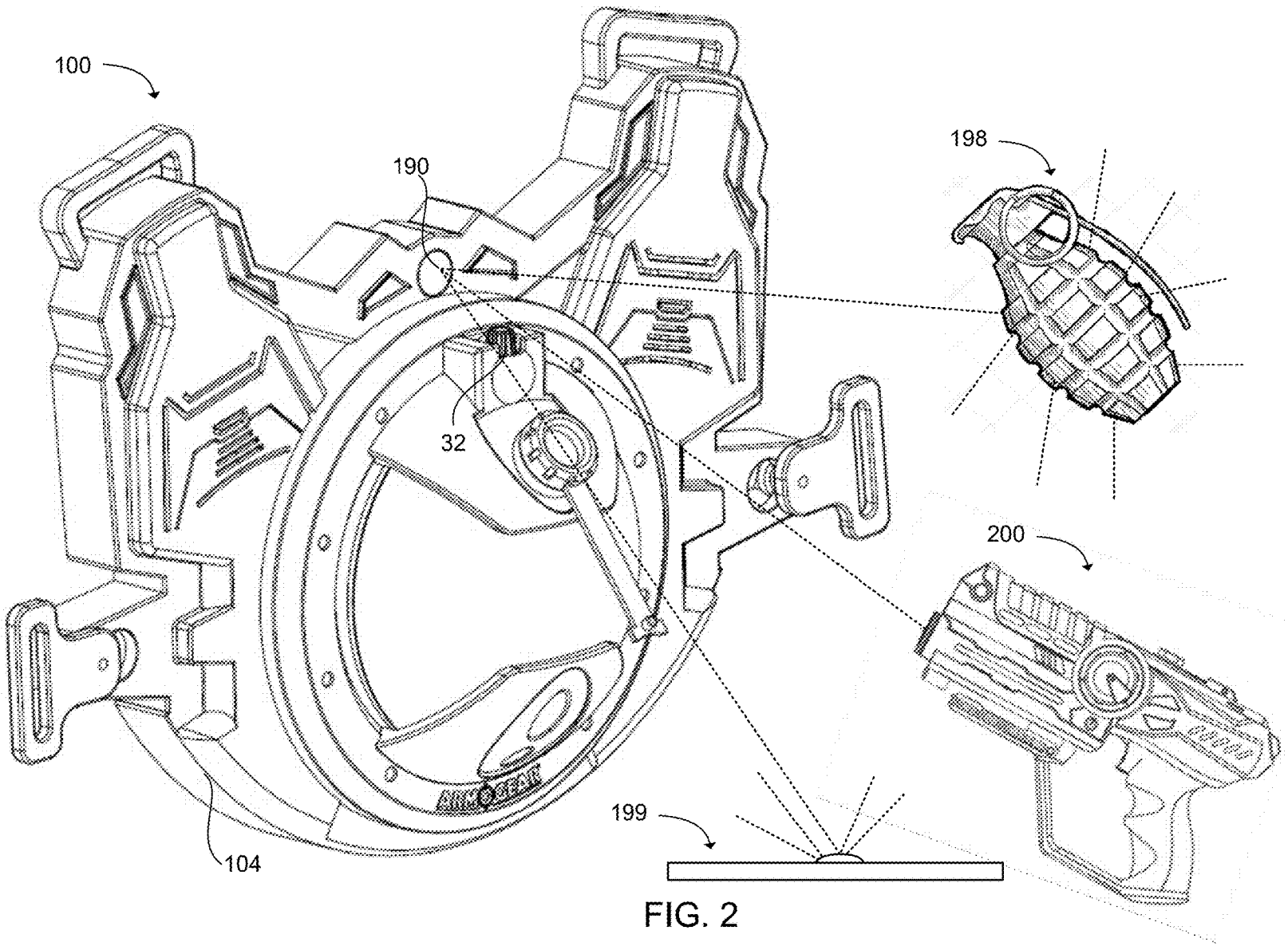
FIG. 2 is a second schematic perspective view of the wearable vest of FIG. 1 in accordance with an embodiment of the present invention.

FIG. 2 provides an example schematic view of the wearable vest 100 having an optical sensor 190 carried by the breastplate 104. The optical sensor 190 is configured to receive an encoded optical signal from one or more of a plurality of optical signal sources. The optical signal can be an infrared or visible wavelength optical signal configured to be received by the optical sensor 190 carried by the breastplate 104. In one example, the optical source can be a laser gun 200. The laser gun 200 can be configured to emit an optical signal encoded with information that is targeted at the optical sensor 190. The information is typically encoded in the optical signal in a binary format. A selected number of n bits can be communicated in the encoded optical signal, such as 2 bits, 3 bits, or 4 bits. The selected number of bits allows $2^n$ selections to be made at the wearable vest 100. For instance, the information conveyed in the optical signal can be used to identify which of $2^n$ teams the optical signal source is associated with. The bits can also be used to convey certain messages, such as instructing the controller 188 to play a selected sound clip on the speaker 194 of the wearable vest 100. Each laser gun is configured to be assigned to a selected team, such as a green team, an orange team, a blue team, or a red team. The team of the laser gun can be encoded in the optical signal transmitted from the laser gun to the optical sensor 190.

The example of the laser gun 200 is not intended to be limiting. Other types of optical signal sources can be used to direct an encoded optical signal towards the optical sensor 190. For instance, a multidirectional optical source, such as a LED lantern can be used to simulate an optical hand grenade 198 that can direct the encoded optical signal towards any wearable vest 100 within a selected distance from the LED lantern when it is turned on. For example, the optical hand grenade 198 can be configured, similar to the wearable vest 100, to be selected for a certain team, such as the red team. The optical hand grenade 198 can be configured so that it does not emit light until it is activated by a user. When the optical hand grenade 198 is activated, the optical hand grenade 198 will emit red light as the optical signal. Alternatively, an additional light emitting diode (LED) may be used other than an LED emitting the team color. For example, an infrared LED may be used to transmit the encoded optical signal. The encoded optical signal from the optical hand grenade 198 will travel towards the optical sensor 190 of each of the wearable vests that are located within a predetermined range of the optical hand grenade.

Every wearable vest 100 that is not on the red team will score a hit from the optical hand grenade 198. The encoded optical signal transmitted from the optical hand grenade can include binary information that informs the controller 188 in each wearable vest 100 the team that the optical hand grenade is assigned to (red in this example), and the type of device that the encoded optical signal is sent from (i.e. an optical hand grenade). The controller 188 in each wearable vest 100 will record the number of hits based on the type of device (i.e. optical hand grenade) that the optical signal was transmitted from and the team that the device is assigned to. In this example, wearable vests that are assigned to the red team will not record a hit from the optical grenade.

Similarly, a pressure activated light source placed on the ground, used to simulate an optical land mine 199, can be configured to direct the encoded optical signal upwards towards the optical sensor 190 on any wearable vest 100 within a selected distance when the pressure activated light source is stepped on and activated.

While a laser gun, optical hand grenade, and optical land mine have been given as examples, they are not intended to be limiting. Other types of light sources can also be used to direct the encoded optical signal at the optical sensor 190 of a wearable vest 100. Each optical signal source can be set to be on a selected team and display a color of the team when activated. Each optical signal source is capable of communicating information. The optical signal source can be a coherent light source, such as a laser, or an incoherent light source such as an LED. The type of optical encoding and decoding used can be determined based on the type of light source used.

The optical sensor 190 can receive the encoded optical signal, and decode and demodulate the signal to determine the binary information in the signal. The binary information can be communicated to the controller 188. In one example, the binary information can identify which team the optical signal source that sent the optical signal is associated with. The controller 188 of the wearable vest 100 can compare the selected team of the optical signal source with the selected team of the wearable vest 100. When the selected team of the optical signal source is different from the selected team of the wearable vest 100, then a signal can be sent by the controller 188 to activate the pump 196 and direct water out of the vessel 130 through the nozzle 32. In one embodiment, when the selected team of the optical signal source is the same as the selected team of the wearable vest 100, then the controller is configured to not send a signal to the pump and no water is directed from the nozzle 32. This minimizes friendly fire hits from a user's own team members.

Each nozzle 32 can have two openings, including a fluid opening 201 that is fluidly coupled with a selected liquid, such as water. In FIG. 9, the air opening is the larger opening at a top of the nozzle 32, as shown by the dashed line B, showing the liquid 206 being directed out of the air opening. The fluid opening 201 is the smaller opening at the side of the nozzle 32. The fluid opening 201 is connected to the selected liquid, such as water, through the tube 13 and the pump 196. The air opening of the nozzle 32 can be directed upwards relative to the front surface 108 of the wearable vest 100. The air opening of the nozzle 32 can be movable, allowing the direction of the nozzle 32 to be adjusted by the user. In one example, the air opening can be directed at a chin of the user. Alternatively, the air opening can be directed at a face of the user. In another embodiment, the air opening can be directed in a downwards direction, to direct the selected liquid at a lower portion of the user below the location where the wearable vest is worn by the user.

Figure 3:
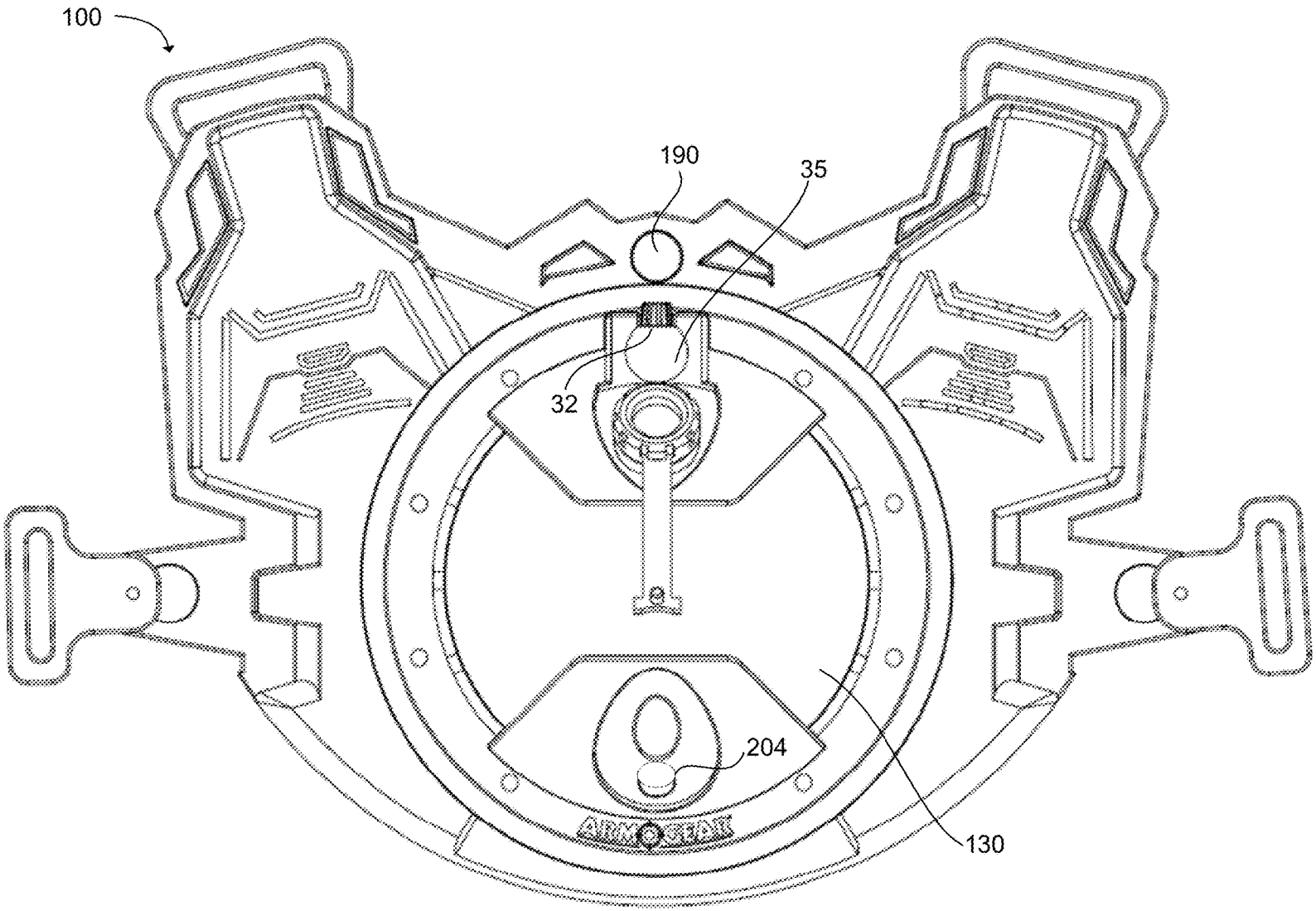
FIG. 3 is a schematic front view of the wearable vest of FIG. 1.

In another embodiment, a pneumatic pump 204 can be attached to the vessel 130, as illustrated in the front view of the wearable vest illustrated in the example of FIG. 3. The pneumatic pump is configured to pressurize air in the vessel. A valve 186 can be coupled in line with the nozzle 32. The valve 186 can be built into the nozzle 32 or connected to the nozzle 32 via a tube 13 (FIG. 9). The valve 186 is electrically coupled to the one or more processors comprising the controller 188. The 186 valve can be opened and closed based on a signal received from the one or more processors. In one embodiment, the pressurized air in the vessel can be used to replace the pump 196. When an optical signal encoded with information is received at the optical sensor 190, the controller 188 can be configured to send a signal to the valve 186 to open the valve 186 to allow water to be directed out of the air opening of the nozzle towards the user for a selected period of time, as previously discussed, based on a selected response of the one or more processors comprising the controller 188. The pressurized air from the pneumatic pump 204 can force the selected liquid 206, such as water, out of the valve 186 while the valve 186 is opened. The pneumatic pump 204 can be manually operated or battery powered with a pump.

In an alternative embodiment, the selected liquid 206 can be the pressurized air. Rather than adding a selected liquid, such as water, to the vessel 130, the vessel can be filled with pressurized air using the pneumatic pump. The valve 186 can then be opened for the selected period of time to emit the selected liquid (pressurized air) at the user for the selected period of time. The use of pressurized air as the selected liquid 206 can allow the wearable vest to be used in an indoor environment. In one example of this embodiment, the pump 196 can be a pneumatic pump configured to fill the vessel 130 with pressurized air.

The controller 188 of the wearable vest 100 can keep track of the number of times that the optical sensor 190 receives an encoded optical signal from an optical signal source that is assigned to a different team than the wearable vest. The controller is configured to select a set reaction of the wearable vest based on the number of times. For example the amount of time that the pump 196 is activated to emit the selected liquid out of the nozzle 32 towards the user can be based on the number of times. In one embodiment, the pump 196 can be activated causing water can be directed out of the nozzle for a set amount of time, such as 0.5 seconds, for the first eight times that the encoded optical signal is received from another team. The controller 188 can turn on the pump 196 for a longer amount of time, such as 2 seconds, at the $9^{th}$ time the encoded optical signal is received from another team. The actual amount of time the pump 196 is activated can vary from a very short burst, such as 0.1 seconds, to a longer time such as 5 seconds. Shorter bursts can allow the water in the vessel 130 to last for longer, enabling multiple games to be played. In one embodiment, the time period for each burst can be selected such that the vessel 130 can hold sufficient water for two games to be played, with approximately 18 water bursts occurring using the water in the vessel 130. The length of the burst can be selected to allow a typical person to feel the water or other liquid in the vessel as it hits the person's skin. When the valve 186 is used in place of the pump 196, the valve 186 can be opened for a similar amount of time as the pump 196 would be operated to allow water to be directed out of the air opening of the nozzle 32 towards the user wearing the wearable vest 100.

The controller 188 of the wearable vest 100 can also cause other actions to be performed each time the encoded optical signal is received at the optical sensor 190 from another team than the team of the wearable vest. In one example, a laser gun on the green team can successfully target the optical sensor 190 of the wearable vest 100 on the blue team. The light source 192 can be changed temporarily from blue to green to show that a member of the green team successfully targeted the wearable vest 100. In addition, the controller can direct a selected prerecorded sound to be played on the speaker 194 of the wearable vest 100 each time it is successfully targeted. The sound can include information that a hit (successful target) occurred, the color of the team that hit the wearable vest, the number of hits that has occurred in the current game, and other desired information. The controller can also be configured to select a reaction based on the type of optical signal source. For example, it can take 9 hits for a laser gun to knock a player out of the game, 3 hits from a grenade, and two hits from a land mine. The duration that the water is turned on can be selected based on the predetermined rules of the game.

The controller 188 can include one or more processors configured as a baseband processor for a transceiver configured to communicate via a selected wireless transmission standard, such as Bluetooth, Wi-Fi, or ZigBee. The wireless transceiver can be configured to communicate with the transceivers of other wearable vests to allow additional communication. In addition, the wireless transceiver can be configured to communicate with a portable computing device, such as a cell phone or tablet. The portable computing device can run an application configured to communicate with the transceiver in the wearable vest. The application can allow different types of game play to be selected, the rules of the game play to be identified (i.e. the number of hits for each type of optical signal source to eject the user of a wearable vest from the game), and updates to firmware in the wearable vest allowing new types of games to be played. The same app can also be used to communicate with the optical signal sources, such as a laser gun, hand grenade, land mine, or other desired optical signal source.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

Various techniques, or certain aspects or portions thereof, can take the form of program code (i.e., instructions) embodied in tangible media, such as floppy diskettes, compact disc-read-only memory (CD-ROMs), hard drives, non-transitory computer readable storage medium, or any other machine-readable storage medium wherein, when the program code is loaded into and executed by a machine, such as a computer, the machine becomes an apparatus for practicing the various techniques. Circuitry can include hardware, firmware, program code, executable code, computer instructions, and/or software. A non-transitory computer readable storage medium can be a computer readable storage medium that does not include signal. In the case of program code execution on programmable computers, the computing device can include a processor, a storage medium readable by the processor (including volatile and non-volatile memory and/or storage elements), at least one input device, and at least one output device. The volatile and non-volatile memory and/or storage elements can be a random-access memory (RAM), erasable programmable read only memory (EPROM), flash drive, optical drive, magnetic hard drive, solid state drive, or other medium for storing electronic data. One or more programs that can implement or utilize the various techniques described herein can use an application programming interface (API), reusable controls, and the like. Such programs can be implemented in a high level procedural or object oriented programming language to communicate with a computer system. However, the program(s) can be implemented in assembly or machine language, if desired. In any case, the language can be a compiled or interpreted language, and combined with hardware implementations.

As used herein, the term processor can include general purpose processors, specialized processors such as VLSI, FPGAs, or other types of specialized processors, as well as baseband processors used in transceivers to send, receive, and process wireless communications.

It should be understood that many of the functional units described in this specification have been labeled as modules, in order to more particularly emphasize their implementation independence. For example, a module can be implemented as a hardware circuit comprising custom very-large-scale integration (VLSI) circuits or gate arrays, off-the-shelf semiconductors such as logic chips, transistors, or other discrete components. A module can also be implemented in programmable hardware devices such as field programmable gate arrays, programmable array logic, programmable logic devices or the like.

In one example, multiple hardware circuits or multiple processors can be used to implement the functional units described in this specification. For example, a first hardware circuit or a first processor can be used to perform processing operations and a second hardware circuit or a second processor (e.g., a transceiver or a baseband processor) can be used to communicate with other entities. The first hardware circuit and the second hardware circuit can be incorporated into a single hardware circuit, or alternatively, the first hardware circuit and the second hardware circuit can be separate hardware circuits.

Modules can also be implemented in software for execution by various types of processors. An identified module of executable code can, for instance, comprise one or more physical or logical blocks of computer instructions, which can, for instance, be organized as an object, procedure, or function. Nevertheless, the executables of an identified module need not be physically located together, but can comprise disparate instructions stored in different locations which, when joined logically together, comprise the module and achieve the stated purpose for the module.

Indeed, a module of executable code can be a single instruction, or many instructions, and can even be distributed over several different code segments, among different programs, and across several memory devices. Similarly, operational data can be identified and illustrated herein within modules, and can be embodied in any suitable form and organized within any suitable type of data structure. The operational data can be collected as a single data set, or can be distributed over different locations including over different storage devices, and can exist, at least partially, merely as electronic signals on a system or network. The modules can be passive or active, including agents operable to perform desired functions.

A method of using the vest 100 described above can comprise: filling the vessel 130 with water; donning the vest 100 or breastplate 104; and avoiding infrared light incident on the sensor 190 from a gun 200. In addition, the method can further comprising firing infrared light from the gun 200 at the infrared sensor 190 of an opponent's vest 100 to cause water to squirt from the opponent's vest at the opponent.

Reference throughout this specification to "an example" or "exemplary" means that a particular feature, structure, or characteristic described in connection with the example is included in at least one embodiment of the present invention. Thus, appearances of the phrases "in an example" or the word "exemplary" in various places throughout this specification are not necessarily all referring to the same embodiment.

As used herein, a plurality of items, structural elements, compositional elements, and/or materials can be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention can be referred to herein along with alternatives for the various components thereof. It is understood that such embodiments, examples, and alternatives are not to be construed as defacto equivalents of one another, but are to be considered as separate and autonomous representations of the present invention.

Furthermore, the described features, structures, or characteristics can be combined in any suitable manner in one or more embodiments. In the following description, numerous specific details are provided, such as examples of layouts, distances, network examples, etc., to provide a thorough understanding of embodiments of the invention. One skilled in the relevant art will recognize, however, that the invention can be practiced without one or more of the specific details, or with other methods, components, layouts, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A wearable vest, the vest comprising:

a breastplate with a back surface configured to face a torso and an opposite front surface configured to face away from the torso;

a vessel carried by the breastplate, the vessel configured to hold a selected liquid;

a nozzle is connected to the vessel, the nozzle having an air opening and a fluid opening configured to be fluidly coupled with the selected liquid;

an optical sensor carried by the breastplate and configured to receive an encoded optical signal from one or more of a plurality of optical signal sources; and one or more processors electrically coupled to the optical sensor, the one or more processors configured to:

determine information in the encoded optical signal;

select a response based on the information in the encoded optical signal;

send a signal, based on the selected response, to enable the selected liquid to be directed out of the vessel through the air opening of the nozzle towards a wearer of the wearable vest for a selected period of time, and a light source optically coupled to the vessel and electrically coupled to the one or more processors, wherein a color of the light source is selected to light the vessel based on a team selected for the wearable vest.

2. The wearable vest of claim 1, further comprising:

a pump carried by the breastplate and fluidly coupled to the vessel; wherein the pump is:

electrically coupled to the one or more processors; and configured to receive the signal from the one or more processors, based on the selected response, and pump the selected liquid out of the vessel and through the air opening of the nozzle for the selected period of time.

3. The wearable vest of claim 1, further comprising:

a pneumatic pump carried by the breastplate, wherein the pneumatic pump is configured to pressurize air in the vessel; and a valve coupled to one of the fluid opening or the air opening of the nozzle, wherein the valve is electrically coupled to the one or more processors to receive the signal and open the valve and direct the selected liquid, forced by the pressurized air from the vessel through the valve and out of the vessel through the air opening of the nozzle for the selected period of time based on the selected response.

4. The wearable vest of claim 1, wherein the nozzle is movable to adjust a direction of the air opening relative to the front surface to control a direction of the selected liquid directed out of the vessel.

5. The wearable vest of claim 1, wherein one or more of the plurality of optical signal sources is one or more of a laser gun, an optical hand grenade, or an optical land mine that are each configured to emit the encoded optical signal as an infrared or visible wavelength optical signal configured to be received by the optical sensor carried by the breastplate.

6. The wearable vest of claim 1, wherein the one or more processors are configured to select the response, comprising:

identify a selected team of the one or more of the plurality of optical signal sources; and determine to send the signal to direct the selected liquid out of the vessel based on the identified selected team of the one or more of the plurality of optical signal sources; or determine to not send the signal to direct the selected liquid out of the vessel based on the identified selected team of the one or more of the plurality of optical signal sources.

7. The wearable vest of claim 1, wherein the one or more processors are further configured to:

determine to send the signal to direct the selected liquid out of the vessel for the selected period of time, wherein the selected period of time is based, in part, on a number of times that the wearable vest has received the encoded optical signal in a game.

8. The wearable vest of claim 1, further comprising a team selection button electrically coupled to the one or more processors, wherein the team selection button is configured to:

select a team for the wearable vest by depressing the team selection button a first to an nth time to select a first to an nth team, respectively, for the wearable vest.

9. The wearable vest of claim 8, wherein the one or more processors are configured to select the response, comprising:

identify a selected team of the one or more of the plurality of optical signal sources; and determine to send the signal to direct the selected liquid out of the vessel when the identified selected team of the one or more of the plurality of optical signal sources is different than the team selected for the wearable vest.

10. The wearable vest of claim 1, further comprising:

an audio speaker carried by the breastplate and electrically coupled to the one or more processors;

wherein the one or more processors are configured to send a selected audio message to be played by the audio speaker based on one or more of a selected team and the encoded optical signal received by the optical sensor.

11. The wearable vest of claim 1, wherein the vessel comprises a bulbous protrusion extending from the front surface of the breastplate and having a lateral dimension occupying a majority of a lateral dimension of the breastplate.

12. The wearable vest of claim 11, wherein the vessel comprises a sealable aperture being formed at least partially in the protrusion, the aperture configured to receive the selected liquid into the vessel.

13. The wearable vest of claim 2, wherein the selected liquid is one or more of water or air.

14. The wearable vest of claim 1, further comprising top attachments connected to the breastplate, and side attachments connected to the breastplates, the top attachments and side attachments each having through holes sized to receive one or more straps configured to secure the breastplate to the torso.

15. The wearable vest of claim 14, wherein the side attachments are connectable to the breastplate via a keyhole in a side attachment acceptor, wherein the side attachment acceptor is connected to the breastplate.

16. A vest for a laser tag game system, the vest comprising:

a breastplate with a back surface configured to face a torso and an opposite front surface configured to face away from the torso;

a vessel carried by the breastplate and having a closable inlet;

a pump carried by the breastplate and fluidly coupled to the vessel;

a power source carried by the breastplate and electrically coupled to the pump;

a sensor carried by the breastplate and electrically coupled to the power source and the pump, the sensor configured to sense an infrared light incident on the sensor to operate the pump;

a nozzle carried by the breastplate and fluidly coupled to the pump; and the nozzle being oriented to face upwardly;

a protrusion extending from a front surface of the breastplate and having a lateral dimension occupying a majority of a lateral dimension of the breastplate;

an aperture being formed at least partially in the protrusion; and the vessel being at least partially located in the protrusion.

17. The vest of claim 16, further comprising:

an aperture in the front surface of the breastplate; and the vessel closing the aperture and being visible through the aperture.

18. The vest of claim 17, further comprising:

at least a portion of the vessel visible through the aperture being at least light translucent, defining an illumination portion; and a light source carried by the breastplate and electrically coupled to the power source, and the light source being positioned to illuminate the illumination portion of the vessel.

19. The vest of claim 16, further comprising:

a bulbous protrusion extending from a front surface of the breastplate and having a lateral dimension occupying a majority of a lateral dimension of the breastplate;

at least a portion of the vessel located in the bulbous protrusion;

an aperture formed in the bulbous protrusion;

the vessel closing the aperture and being visible through the aperture; and a light source carried by the breastplate and electrically coupled to the power source, and the light source being positioned to illuminate the vessel visible through the aperture.

20. The vest of claim 19, further comprising:

the nozzle being positioned on the bulbous protrusion.

21. The vest of claim 16, further comprising:

the vessel having a hemispherical dome extending from the front surface of the breastplate;

an upper lobe extending from the front surface of the breastplate and over an upper portion of the hemispherical dome of the vessel;

a lower lobe extending from the front surface of the breastplate and over a lower portion of the hemispherical dome of the vessel; and the hemispherical dome of the vessel being exposed through the front surface of the breastplate between the upper and lower lobes.

22. The vest of claim 16, further comprising:

the breastplate having a front wall;

a sealable aperture of the vessel comprising a nipple extending through the front wall of the breastplate; and a cover removably coupled to the nipple.

23. The vest of claim 16, further comprising:

an audio speaker carried by the breastplate.

24. The vest of claim 16, further in combination with a light gun configured to emit infrared light.

25. The vest of claim 16, further in combination with a laser tag game system, the system comprising:

at least a pair of vests; and at least a pair of guns configured to emit infrared light.

26. A vest for a laser tag game system, the vest comprising:

a breastplate/gorget with a back surface configured to face a torso and an opposite front surface configured to face away from the torso;

at least one strap coupled to the breastplate and forming a loop with the breastplate and configured to secure the breastplate to the torso;

a bulbous protrusion extending from a front surface of the breastplate;

a bladder/vessel carried by the breastplate and having a closable inlet;

the bladder having a hemispherical dome located in the bulbous protrusion of the breastplate;

an aperture formed in the bulbous protrusion;

the hemispherical dome of the bladder closing the aperture and being visible through the aperture;

an upper lobe extending from the front surface of the breastplate and over an upper portion of the hemispherical dome of the bladder;

a lower lobe extending from the front surface of the breastplate and over a lower portion of the hemispherical dome of the bladder;

a pump carried by the breastplate and fluidly coupled to the bladder;

a power source carried by the breastplate and electrically coupled to the pump;

a sensor carried by the breastplate and electrically coupled to the power source and the pump, the sensor configured to sense an infrared light incident on the sensor to operate the pump; and a nozzle carried by the breastplate, positioned on the upper lobe, and fluidly coupled to the pump; and the nozzle being oriented to face upwardly or downwardly.

27. A wearable vest, the vest comprising:

a breastplate with a back surface configured to face a torso and an opposite front surface configured to face away from the torso;

a vessel carried by the breastplate, the vessel configured to hold a selected liquid;

a nozzle is connected to the vessel, the nozzle having an air opening and a fluid opening configured to be fluidly coupled with the selected liquid;

an optical sensor carried by the breastplate and configured to receive an encoded optical signal from one or more of a plurality of optical signal sources; and one or more processors electrically coupled to the optical sensor, the one or more processors configured to:

determine information in the encoded optical signal;

select a response based on the information in the encoded optical signal;

send a signal, based on the selected response, to enable the selected liquid to be directed out of the vessel through the air opening of the nozzle towards a wearer of the wearable vest for a selected period of time; and wherein the vessel comprises a bulbous protrusion extending from the front surface of the breastplate and having a lateral dimension occupying a majority of a lateral dimension of the breastplate.

* * * * *